United States Patent [19]

La Salle

[11] Patent Number: 4,973,184

[45] Date of Patent: Nov. 27, 1990

[54] WRITING PAD ORGANIZER

[76] Inventor: Roger J. La Salle, 156 McGowans Road, Donvale 3111, Victoria, Australia

[21] Appl. No.: 335,763

[22] Filed: Apr. 10, 1989

Related U.S. Application Data

[63] Continuation-in-part of Ser. No. 239,315, Sep. 1, 1988, abandoned.

[51] Int. Cl.[5] ..... B42F 5/00

[52] U.S. Cl. ..... 402/70; 281/15.1; 281/21.1; 402/80 P

[58] Field of Search ..... 281/15.1, 21.1, 25, 281/29, 30, 31, 20; 402/68, 70, 80 R, 80 P

[56] References Cited

U.S. PATENT DOCUMENTS

| | | | |
|---|---|---|---|
| 2,879,774 | 3/1959 | Siegel | 281/31 X |
| 4,002,355 | 1/1977 | Sendor | 281/29 |
| 4,075,702 | 2/1978 | Davies | 281/30 X |
| 4,255,872 | 3/1981 | Williams, Sr. | 281/30 X |
| 4,306,737 | 12/1981 | Errichiello | 281/30 X |
| 4,407,410 | 10/1983 | Graetz et al. | 281/31 X |
| 4,630,843 | 12/1986 | Willat | 281/30 |
| 4,724,957 | 2/1988 | Burgschweiger | 281/31 X |
| 4,907,904 | 3/1990 | Baldwin | 281/21.1 X |

FOREIGN PATENT DOCUMENTS

| | | | |
|---|---|---|---|
| 12523 | of 1895 | United Kingdom | 281/30 |

*Primary Examiner*—Paul A. Bell
*Attorney, Agent, or Firm*—Jack C. Munro

[57] ABSTRACT

A writing pad organizer which comprises a back flap and a front flap which are connected together through a spine. The front flap is capable of being interlocked with the back flap to hold such in a closed position. The front flap is capable of being hingedly moved relative to the back flap to expose an interior compartment located within the inner surface of both the front flap and the back flap. The interior surface of the back flap is to include a plurality of file folders with the interior surface of the front flap including a plurality of separate note pads. The sheets of the note pads are to be removed and adhered to the file folders at designated areas.

7 Claims, 4 Drawing Sheets

WRITING PAD ORGANIZER

REFERENCE TO PRIOR APPLICATION

This application is a continuation-in-part of U.S. patent application Ser. No. 239,315, filed Sept. 1, 1988 by the same inventor, now abandoned.

BACKGROUND OF THE INVENTION

The field of this invention relates to stationery equipment and more particularly to book-like organizer in which the interior surface of the front and back flaps are specifically constructed to accommodate writing pads.

The use of writing pads is quite common. One type of writing pad is an enlarged pad which includes a plurality of sheets of paper which may be lined or unlined and upon which either writing or drawing is to be permitted. Other types of writing pads are smaller sized pads which include readily tear-off sheets with each sheet including a gum adhesive on its back surface. These sheets can be written upon and removed and readily adhered to another structure.

Although these different types of writing pads are available, there has been minimal effort expended in designing a device to facilitate the usage of these different types of pads. A businessman or woman will typically find daily usage of both types of pads. It would be desirable to design some type of a structure in which these pads can be readily available to be used at a moment's notice.

Previously, there have been attempts at constructing such an organizer. However, in the past these types of organizers have been complex in construction and not as convenient for usage as one would like and also expensive to manufacture and, therefore, expensive for the consumer to purchase. There is a need for an improved quality organizer which overcomes the previously noted disadvantages.

SUMMARY OF THE INVENTION

A writing pad organizer which is defined in a basic configuration of a book which has a back flap and a front flap which are connected together by a spine. The front flap is movable relative to the back flap between a closed position and an open position. The interior surface of the front flap defines an interior compartment as does also the interior surface of the back flap. When the front flap is closed relative to the back flap, access into the interior compartments is prevented. With the front flap in an open position relative to the back flap, access into the interior compartments is permitted. The wall surface of the interior compartment of the back flap includes a slot which is to facilitate engagement with an enlarged writing tablet or a series of interconnected loose leafs. The interior surface of the front flap includes a plurality of walled in areas with each walled in area being adapted to connect with a separate note pad, a stack of business cards, a calculator, or even writing instruments. There is also provided file folder attaching means at the spine to permit mounting of file folders that are located between the front flap and the back flap.

The primary objective of the present invention is to construct a writing pad organizer which when connected with writing tablets facilitates their usage in an easy and convenient manner.

Another objective of the present invention is to construct a writing pad organizer which can be manufactured relatively inexpensively and, therefore, sold to the ultimate consumer at a relatively inexpensive price.

DETAILED DESCRIPTION OF THE SHOWN EMBODIMENT

Figure 1:
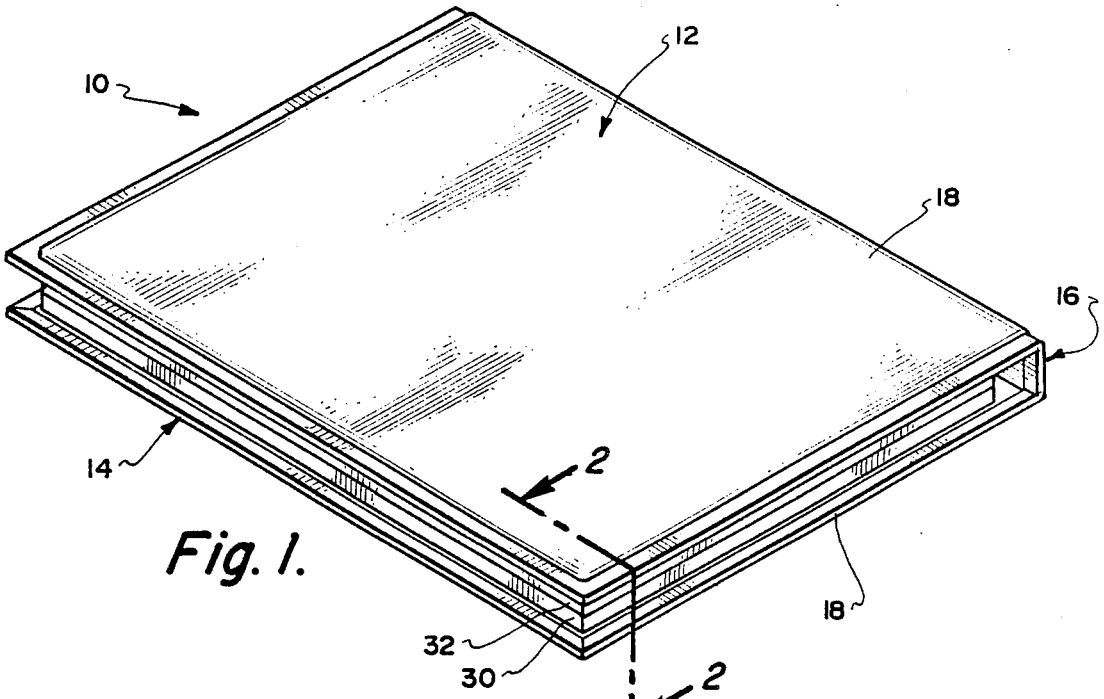
FIG. 1 is a perspective view of the writing pad organizer of the present invention showing the organizer in the closed position.
Figure 2:
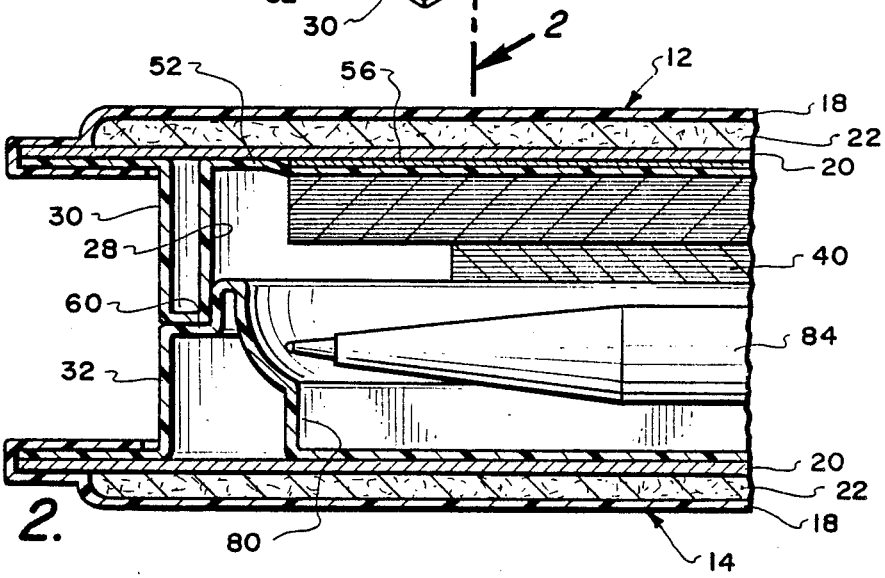
FIG. 2 is a cross-sectional view through a corner of the writing pad organizer of the present invention taken along line 2—2 of FIG. 1.

Referring particularly to the drawings, there is shown the writing pad organizer 10 of this invention. The writing pad organizer is formed into a book-like configuration therebeing a back flap 12 and a front flap 14. The back flap 12 is connected by a spine 16 to the front flap 14. Both the front flap 14 and the rear flap 12 are integral with the spine 16. The front flap 14 and the rear flap 12 and the spine 16 are each constructed of an exterior sheet material flexible cover 18 and an interior sheet material rigid layer 20. In between the layer 20 and the cover 18 is a fibrous pad 22. This fibrous pad 22 is for the purpose of providing a cushiony affect when handled by a human being.

The rear flap 12 and the spine 16 is divided by a crease 24 formed within the layer 20. This crease 24 extends entirely from the upper edge to the lower edge of the organizer 10. A similar crease 26 separates the front flap 14 from the spine 16. The creases 24 and 26 are located parallel to each other. It is the function of the crease 24 to permit pivoting of the back flap 12 from the open position shown in FIG. 3 to a ninety degree displaced position which is the position that is occupied when the organizer is closed as is shown in FIG. 1. In a similar manner, the crease 26 permits pivoting of the front flap 14 relative to the sine 16.

The interior surface of the back flap 12 is defined into interior chamber 28. This interior chamber 28 is formed by means of an enclosing upstanding wall 30. Wall 30 is located directly adjacent but slightly spaced from the rectangular shaped periphery of the back flap 12. In a similar manner, there is located an upstanding enclosing wall 32 formed on the interior surface of the front flap 14. Interior chamber 34 is enclosed by means of the wall 32. The portion of the wall 32 that is directly adjacent to the crease 26 includes a ledge 36. The function of the ledge 36 will be described further on in this specification.

The portion of the wall 30 that is located nearest the crease 24 is cut away forming a lower height ledge 38. Resting on the ledge 38 are a plurality of sheet material, file folders 40 which are located in juxtaposition. It is to be noted that there are four in number of file folders 40 being shown. However, it is considered to be within the scope of this invention that the file folders 40 could be increased or decreased in number without departing from the scope of this invention.

The back end of the file folders 40 is attached as by sewing 42 to stiffener layer 20. At the sewing 42 between the stiffener layer 20 and the file folders 40 is located a layer of thin material 44, usually plastic, which is an extension of the wall 30. This layer 44 extends entirely across the spine 16 and is integral with the wall 32. Covering this layer 44 is an outer layer 46 which extends from directly adjacent the wall 32 to over a portion of the file folders 40 and is connected also by the sewing 42.

Figure 7:
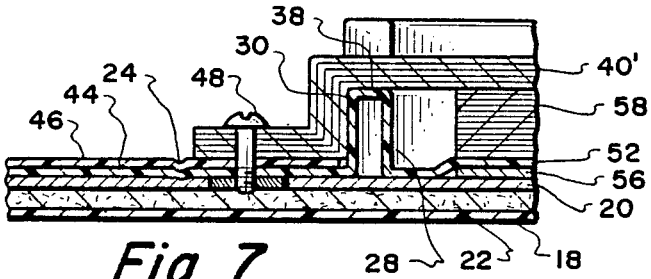
FIG. 7 is a view similar to FIG. 6 but showing a second way in which the file folders could be attached in conjunction with the spine.
Figure 8:
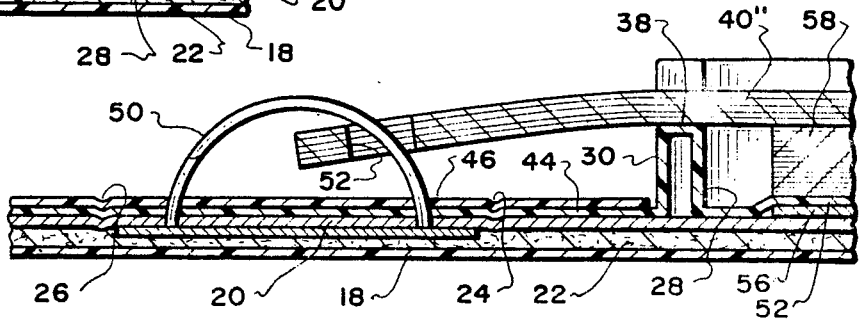
FIG. 8 is a view similar to FIG. 6 but of a third way in which the file folder can be attached in conjunction with the spine.

Referring particularly to FIGS. 7 and 8, there is shown alternate forms of connection of the file folders 40 to the stiffener layer 20. Within FIG. 7, the file folders 40′ are connected through the use of a conventional bolt-type of fastener 48. Within FIG. 8, instead of using a bolt-type fastener there is used a half ring 50 with the file folders 40′ including holes 52 through which the ring 50 is conducted. It is understood that tearing 50 is capable of being split so as to facilitate connection and disconnection of file folders 40″ relative to the ring 50. Located within the confines of the space enclosed by the wall 30 is a thin plastic cover layer 52. This cover layer 52 is also integral with the upstanding wall 30. Formed within this cover layer is located an elongated slot 54. Through the slot 54 is to be conducted a cardboard backing sheet 56 of a conventional writing tablet 58. This writing tablet 58 is to be confined within the interior compartment 28.

When the organizer 10 is located in the closed position as shown in FIG. 1, the file folders 40 are to rest on the ledge 36 to provide a means for support of the tablet 58 as well as the file folders 40 when the organizer 10 is in a closed position.

Figure 3:
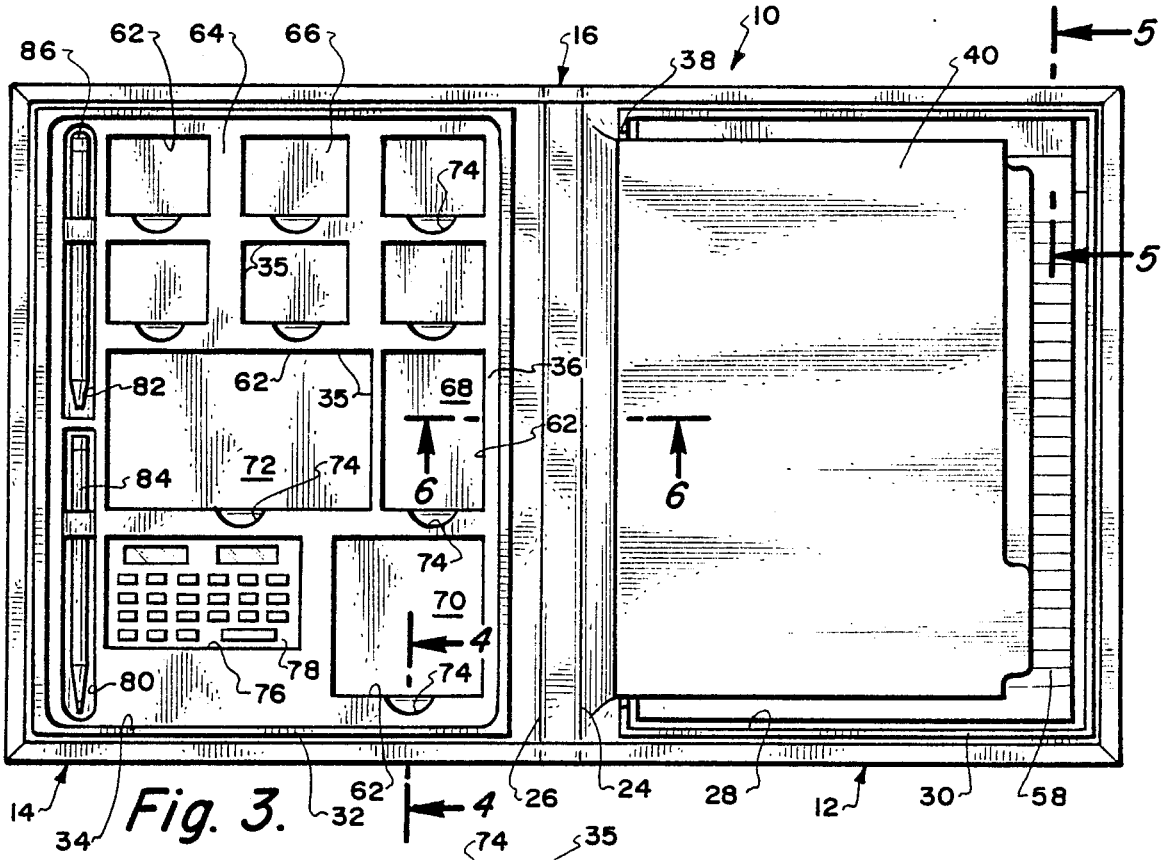
FIG. 3 is a top plan view of the writing pad organizer of the present invention showing the organizer in the open position and taken along the direction toward the interior surfaces of the organizer.
Figure 4:
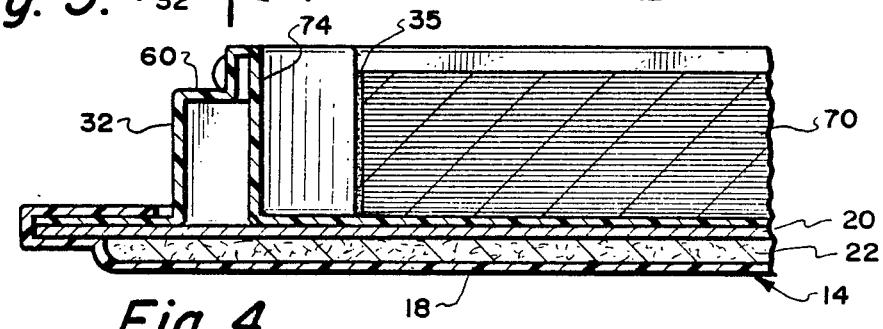
FIG. 4 is a cross-sectional view taken along line 4—4 of FIG. 3.
Figure 5:
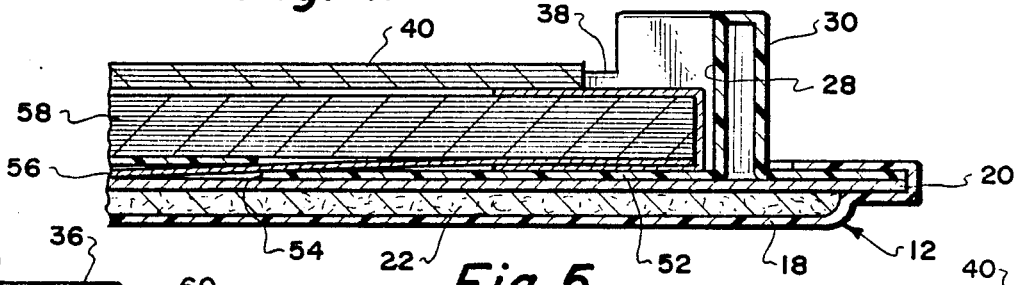
FIG. 5 is a cross-sectional view taken along line 5—5 of FIG. 3.
Figure 6:
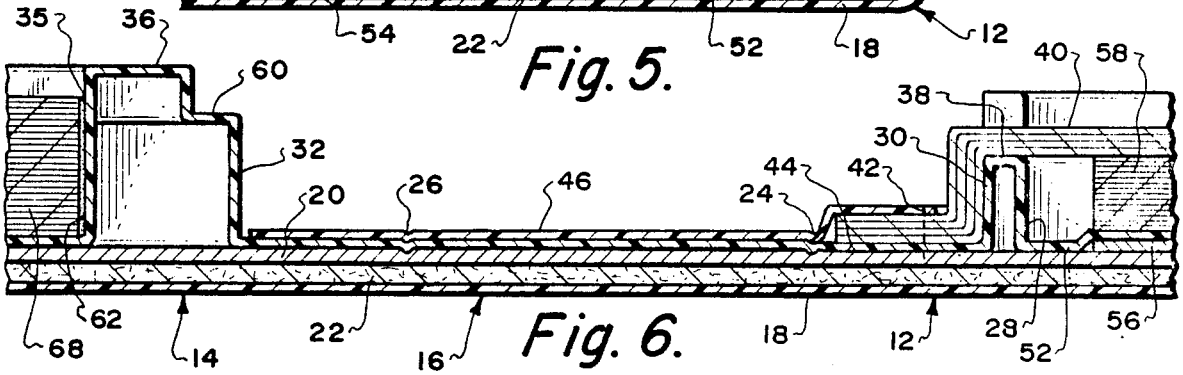
FIG. 6 is a cross-sectional view taken along line 6—6 of FIG. 3 showing a first way in which sheet material file folders may be mounted in conjunction with the spine.
Figure 9:
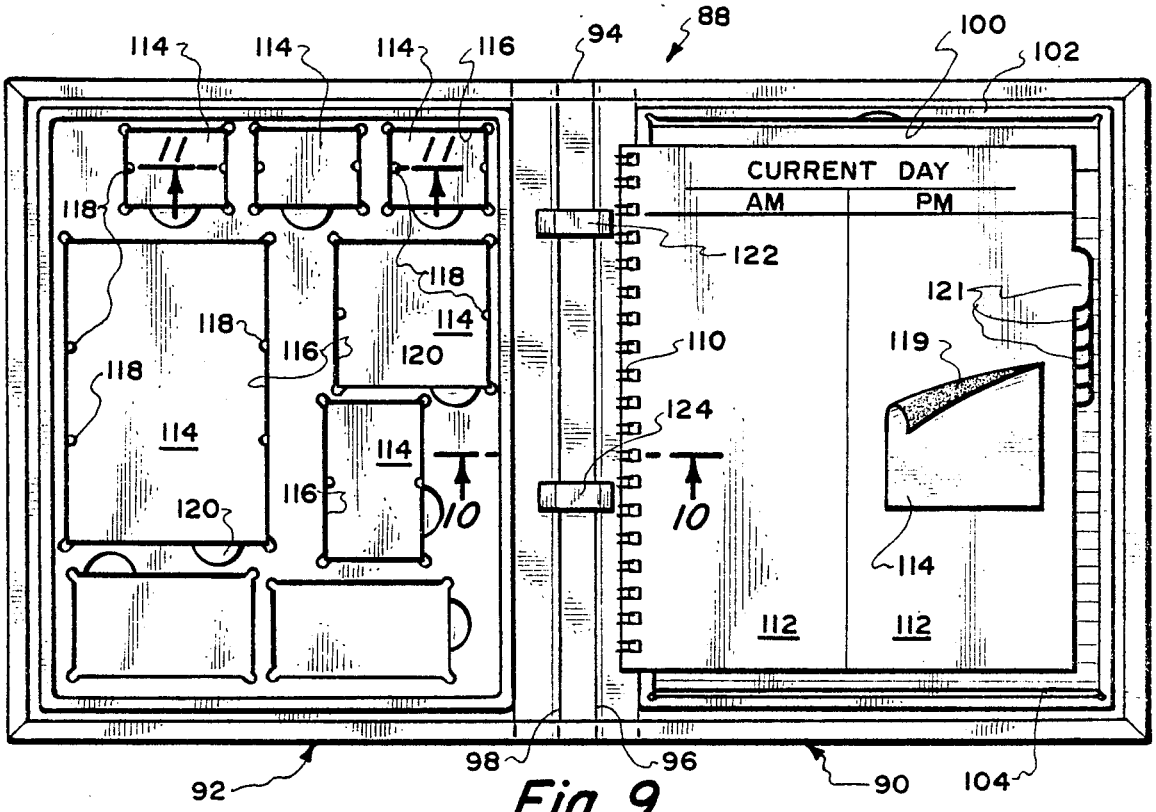
FIG. 9 is a view similar to FIG. 3 showing a modified form of the writing pad organizer of the present invention.
Figure 10:
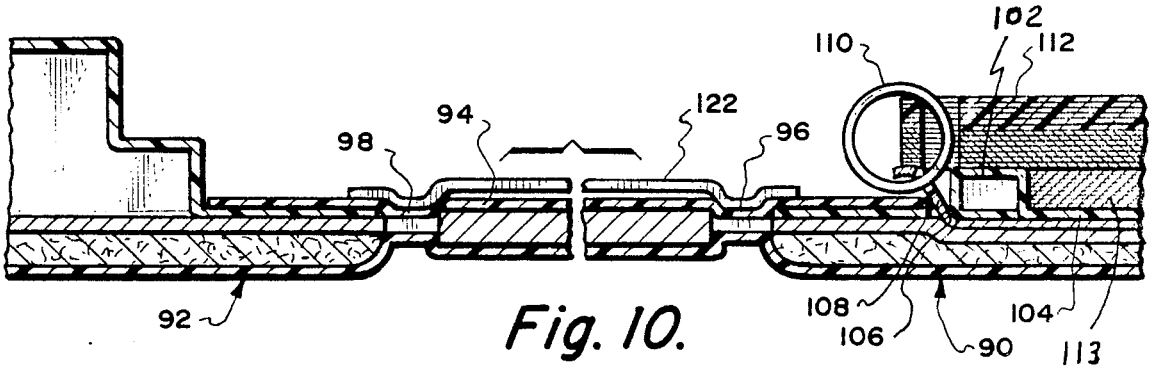
FIG. 10 is a cross-sectional view through the spine portion of the writing pad organizer of this invention taken along line 10—10 of FIG. 9.
Figure 11:
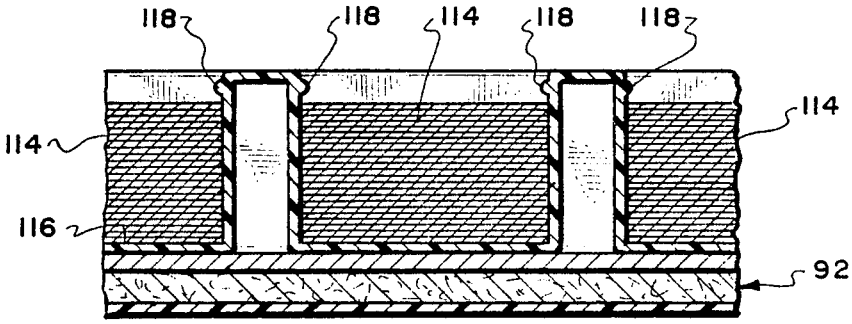
FIG. 11 is a cross-sectional view showing in more detail the pockets that are used to hold the note pads incorporated within the writing pad organizer of the present invention.
Figure 12:
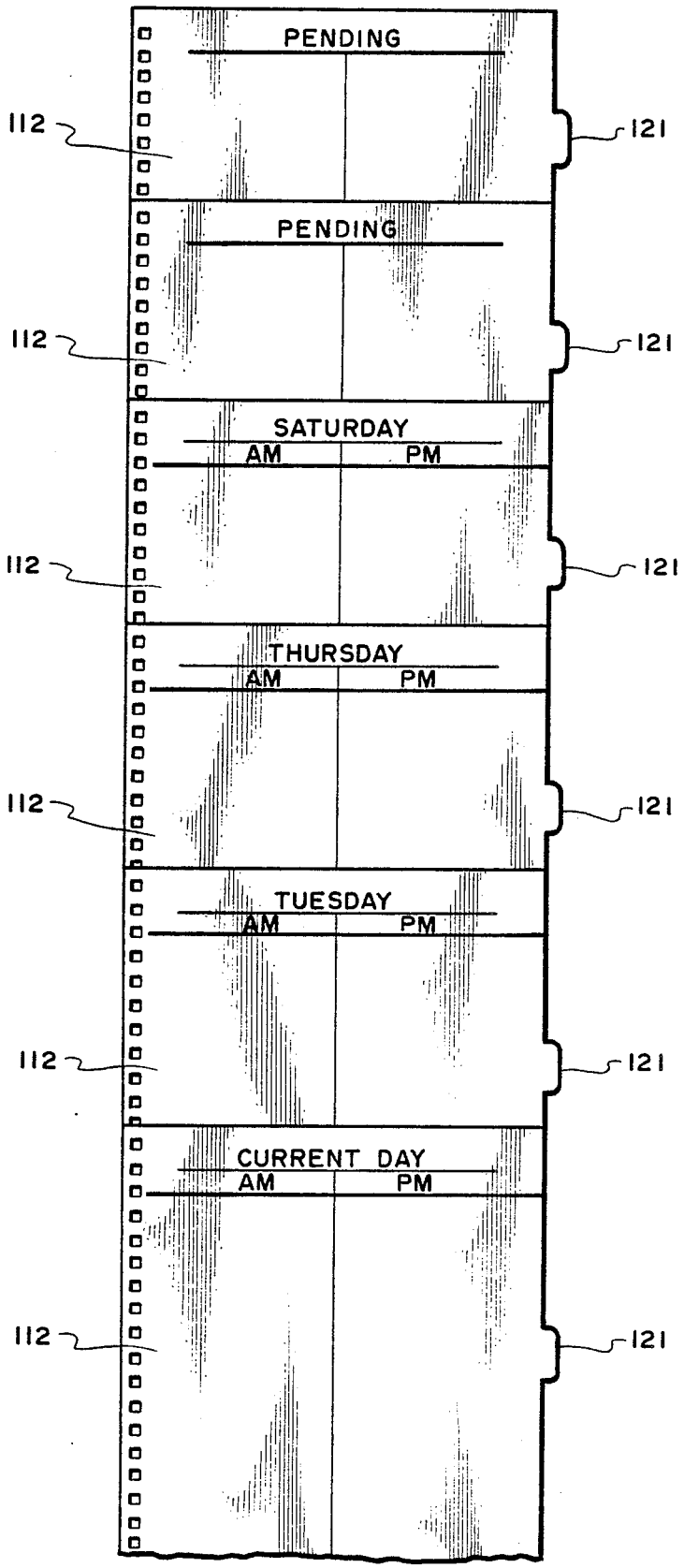
FIG. 12 is an exploded front view of the file folders incorporated within the writing pad organizer of this invention showing the different types of file folders that are to be used.

The wall 32 includes an indented section 60. When the organizer 10 is in the closed position, the outer end of the wall 30 is to connect with the indented section 60 and actually snug interlocking therebetween occurs. This snug interlocking is sufficient to maintain the organizer 10 in a closed position until it is manually opened by the application of force to the open position as shown in FIG. 3.

Formed within the surface of the interior chamber 34 are a plurality of pockets 62. Each pocket 62 is a recessed section within the surface 64 of the chamber 34. The surface 64 is the same height as ledge 36. The side wall of each pocket 62 will normally be constructed in such a manner that it will tightly engage with a note pad 66 to prevent accidental dislodgement of the note pad 66. The side wall of each pocket 62 is to include a bristle type of fabric 35 which retrains the note pad 66. It is to be noted that there are shown six in number of smaller sized note pads 66, a slightly larger size note pad 68, a further larger note pad 70 and an enlarged note pad 72. Each of the pads 66 through 72 are basically constructed in the same manner to comprise a mass of leaves which have an adhesive strip on its back thereof. Each leaf can be removed from each pad and placed on an exterior structure (not shown). Formed within surface 64 is a notch area 74 for each note pad 66, 68, 70 nd 72. The function of the notch area 74 is to facilitate entry of the finger of a human being in order to affect removal of a note pad 66 through 72 when such is deemed to be desired in order to affect replacement.

Also formed within layer 64 is another sized pocket 76. Within this pocket 76 is to be located a conventional thin calculator 78.

Also formed within the layer 64 are a pair of elongated compartments 80 and 82. Within each compartment 80 and 82 there is to be located a writing instrument such as a ball point pen 84 within the compartment 80 or a pencil 86 within compartment 82.

It is to be noted that when the organizer 10 is in the closed position, an interlocking connection between the walls 30 and 32 is such that access into the interior chambers 28 and 34 is prevented, nor is it possible for any of the note pads, pencils, calculators and other items to be accidentally removed from the organizer 10.

Referring particularly to FIGs. 9 through 12 of the drawings, there is shown a modified form of a writing pad organizer 88 of this invention which has a back flap 90 and a front flap 92. Connecting the back flap 90 and the front flap 92 is a pine 94. Incorporated within the spine 94 are a pair of parallel, spaced apart, elongated creases 96 and 98. Both the front flap 92 and the back flap 90 are integral the spine 94. Construction of the flaps 90 and 92 are basically similar to the construction of the aforementioned flaps 12 and 14. The creases 96 and 98 are similar to previous creases 24 and 26 and are for the same purpose.

The interior surface of the back flap 90 defines an interior chamber 100 which is formed by enclosing upstanding wall 102. Wall 102 is similar to wall 30 with the interior chamber 100 being similar to interior chamber 28. It is to be noted that upstanding wall 102 is basically rectangular. The interior chamber 100 has a bottom layer 104. Resting on the bottom layer 104 is a separate conventional writing tablet 113. The bottom layer 104 defines a continuously open slot 106 in the area of the connection to the spine 94.

Within the slot 106 is to be located a sheet material flap 108. Flap 108 is mounted on a mounting ring 110. Also mounted on the ring 110 are a plurality of file folders 112. Each file folder 112 has a front surface and a back surface. The file folder 112, located at the top of the stack (the observed file folder in FIG. 9), includes indicia defining CURRENT DAY and is divided into a left-hand column denoted as "AM" and a right-hand column denoted as "PM". The inner layer (not shown) of this same file folder 112 includes indicia defining "MONDAY" and also again, the same "AM" and "PM" columns. The next file folder 112 in the stack has on its upper or outermost surface indicia denoted as "TUESDAY" with again the "AM" and "PM" columns. This inner layer (not shown) of this file folder has indicia noted as "WEDNESDAY" and again the "AM" and "PM" columns. This continues for the next two file folders 112 representing the days "THURSDAY", "FRIDAY", "SATURDAY", and "SUNDAY". There will be two more file folders 112 which include the word "PENDING" as opposed to a day of the week, but will not include the "AM" and "PM" columns.

The purpose of the file folders 112 and the "AM" and "PM" columns is as follows. NOtes can be inscribed on the sheets of the note pads 114. The note pads 114 are of different sizes and are each mounted within a similarly sized pocket 116 formed within the interior surface of the front flap 92. Associated with the side walls of each pocket 116 are a plurality of protruding notches 118. It is the function of the notches 118 to prevent accidental removal of a note pad 114 from the pocket 116. In other words, the notches 118 require that each note pad 114 be formed into its respective pocket 16 past notches 118. However, since only a single sheet of a note pad 114 will be removed at a time, with this removal being facilitated by the location of a separate thumb recess 120 associated with each pocket 116, ease of removal of each sheet of the note pad 114 past notches 118 is permitted.

It is to be kept in mind that each sheet of each note pad 114 includes on its reverse side a strip of adhesive 119. This sheet of the note pad can then be adheringly placed at an appropriate location on the file folders 112. In other words, on the outermost file folder 112 a sheet of a note pad 114 could be located in the AM section of the current day which would give an indication that there is a certain matter to be taken care of during the AM of the current day. In a similar manner, if something is placed within the PM column of the current day, then there is a reminder note to the affect that something needs to be taken care of during that period of time. The same holds true for each of the days of the week. If a particular reminder note cannot be assigned to a particular day of the week matter, then it can be located on the file folder 112 marked "PENDING".

It is to be noted that each of the file folders 112 on their free lateral edge thereof includes a tab 121. The tabs 121 of the file folders 112 are out of alignment. These tabs 121 facilitate manual turning of the file folders 112. These tabs 121 are out of alignment to facilitate individual turning of a file folder 112 with respect to the remaining file folders 112.

Also mounted in conjunction with the spine 94 are a pair of strips 122 and 124. It is the function of these strips 122 and 124 to facilitate locating of a writing instrument, such as a pen or pencil, between the strips 122 and 124 and the spine 94. These strips 122 and 124 will secure and retain in position the writing instrument(s). However, the strips 122 and 124 will permit easy withdrawal of a writing instrument. Such writing instrument are not shown.

There will probably be a specific pocket 116 for a calculator and a pocket 116 for business cards.

What is claimed is:

1. A writing pad organizer comprising:

a back flap defining a first enclosing interior compartment, said back flap having a first portion of a locking means;

a front flap defining a second enclosing interior compartment, said front flap having a second portion of a locking means, said second portion engageable with said first portion to hold said front flap in juxtaposition with said back flap;

a spine connecting said back flap to said front flap, said back flap being hingedly movable relative to said front flap to an open position providing access into both said first and second interior compartments;

a plurality of file folders mounted on said back flap and located within said first enclosing interior compartment, each said file folder including day and time designated areas, therebeing a separate single page of said file folders for each said day of the week; and a plurality of pockets mounted on said front flap within said second enclosing interior compartment, each said pocket including a note pad, each said note pad including a plurality of sheets located in a stacked relationship, each said sheet having an adhesive strip, a said sheet to be removed from its respective said note pad and placed on and adhered to a said page at a said designated area.

2. The writing pad organizer as defined in claim 1 wherein:

each said pocket including a notch, said notch facilitating entry of a thumb of a human being to facilitate entry and removal of said sheets of said note pad.

3. The writing pad organizer as defined in claim 2 wherein:

means for retaining each said note pad within its respective said pocket, said means to engage with the edges of said note pad.

4. The writing pad organizer as defined in claim 3 wherein:

said means comprises a plurality of protuberances mounted on the side wall of each said pocket.

5. The writing pad organizer as defined in claim 1 including:

a separate pocket adapted to receive a calculator, said separate pocket being mounted on said front flap within said second enclosing interior compartment and located directly adjacent said pockets.

6. The writing pad organizer as defined in claim 1 including:

file folder mounting means associated with said spine, said file folder mounting means for mounting said file folders between said front flap and said back flap when said front flap is in juxtaposition with said back flap.

7. The writing pad organizer as defined in claim 1 including:

writing instrument chamber receiving mean mounted on said spine.

* * * * *